US006037852A

United States Patent [19]

Pfab

[11] Patent Number: 6,037,852

[45] Date of Patent: Mar. 14, 2000

[54] MAGNET DAMPING ARRANGEMENT

[75] Inventor: Hans Pfab, Hahnbach, Germany

[73] Assignee: Siemens AG, Munich, Germany

[21] Appl. No.: 09/051,252

[22] PCT Filed: Oct. 2, 1996

[86] PCT No.: PCT/DE96/01901

§ 371 Date: Aug. 28, 1998

§ 102(e) Date: Aug. 28, 1998

[87] PCT Pub. No.: WO97/14165

PCT Pub. Date: Apr. 17, 1997

[30] Foreign Application Priority Data

Oct. 12, 1995 [DE] Germany ..... 195 38 056

[51] Int. Cl.[7] ..... H01F 7/08

[52] U.S. Cl. ..... 335/274; 335/131; 335/132; 335/257; 335/277

[58] Field of Search ..... 335/131–134, 335/220, 257, 274, 277, 222–226

[56] References Cited

U.S. PATENT DOCUMENTS

| | | | |
|---|---|---|---|
| 2,920,254 | 1/1960 | Ray | 335/129 |
| 3,013,768 | 12/1961 | La Mastra | 335/174 |
| 3,750,066 | 7/1973 | Lazenby | 335/274 |
| 5,428,330 | 6/1995 | Tamemoto | 335/236 |

FOREIGN PATENT DOCUMENTS

| | | |
|---|---|---|
| 660 355 | 6/1995 | European Pat. Off. . |
| 24 57 608 | 6/1976 | Germany . |
| 41 23 369 | 4/1993 | Germany . |
| 42 03 803 | 8/1993 | Germany . |

*Primary Examiner*—Michael L. Gellner
*Assistant Examiner*—Raymond Barrera
*Attorney, Agent, or Firm*—Kenyon & Kenyon

[57] ABSTRACT

An inexpensive and simple magnet damping arrangement, in particular for contactors with a.c. solenoids, is to be created. The non-switching magnet yoke of an electromagnet system with magnet coil is damped by a single damping compression spring which is supported on the bobbin of the magnet coil at one end and directly on the magnet yoke at the other end.

2 Claims, 3 Drawing Sheets

MAGNET DAMPING ARRANGEMENT

FIELD OF THE INVENTION

The invention relates to a magnet damping arrangement for damping a non-switching magnet yoke of an electromagnet system with a magnet coil, in particular for a switching device, e.g., a contactor, where the magnet yoke is held and damped by spring force.

BACKGROUND INFORMATION

A magnet damping arrangement is described in German Patent Application No. 24 57 608. The non-switching magnet part described therein is pressed in the direction of the bottom of a magnet chamber by a bar and two damping compression springs. An insert is placed between the non-switching magnet part and the bottom of the magnet chamber. The damping compression springs are supported by the bar at one end and on a housing-mounted coil of an electromagnetic switching device at the other end. Instead of compression springs, it is also possible to use plate springs which press the magnet yoke to the bottom of the magnet chamber over a bar.

With the magnet damping arrangements, the impact-vibration processes which occur because of the relatively high closing speeds when closing an a.c. solenoid are damped. These vibration processes, which are known in conjunction with contactors having a.c. solenoids, have effects on the electrical and mechanical lifetime of the contactors.

SUMMARY OF THE INVENTION

An object of the present invention is to improve a magnet damping arrangement to lower its cost. The cost would be lower so that the cost is because of a simple design with the fewest possible parts and short assembly times are required. This object is achieved according to the present invention by providing a single damping compression spring in a central position to the magnet yoke in a central position to the magnet yoke for damping the magnet yoke and supporting the bobbin of the magnet coil at one end and directly on the magnet yoke at the other end.

It is advantageous if the damping compression spring is designed as a conical wire spring, because it takes up very little space in height when compressed.

First holding elements that serve to support and center the damping compression spring are advantageously provided on one end face of the bobbin.

It is also advantageous if second holding elements are provided on the inside surface of the magnet yoke facing the bobbin to support the damping compression spring.

The magnet yoke is advantageously designed in an E shape, and the damping compression spring is held by the middle leg of the magnet yoke.

It is further advantageous if the larger-diameter spring end spire of the conical wire spring is supported on the bobbin, and if the other spring end spire is placed around the middle leg of the magnet yoke.

For further damping of the magnet yoke, it is expedient if a damping rubber part is placed between the magnet yoke and the bottom of the housing.

DETAILED DESCRIPTION OF THE INVENTION

Figure 1:
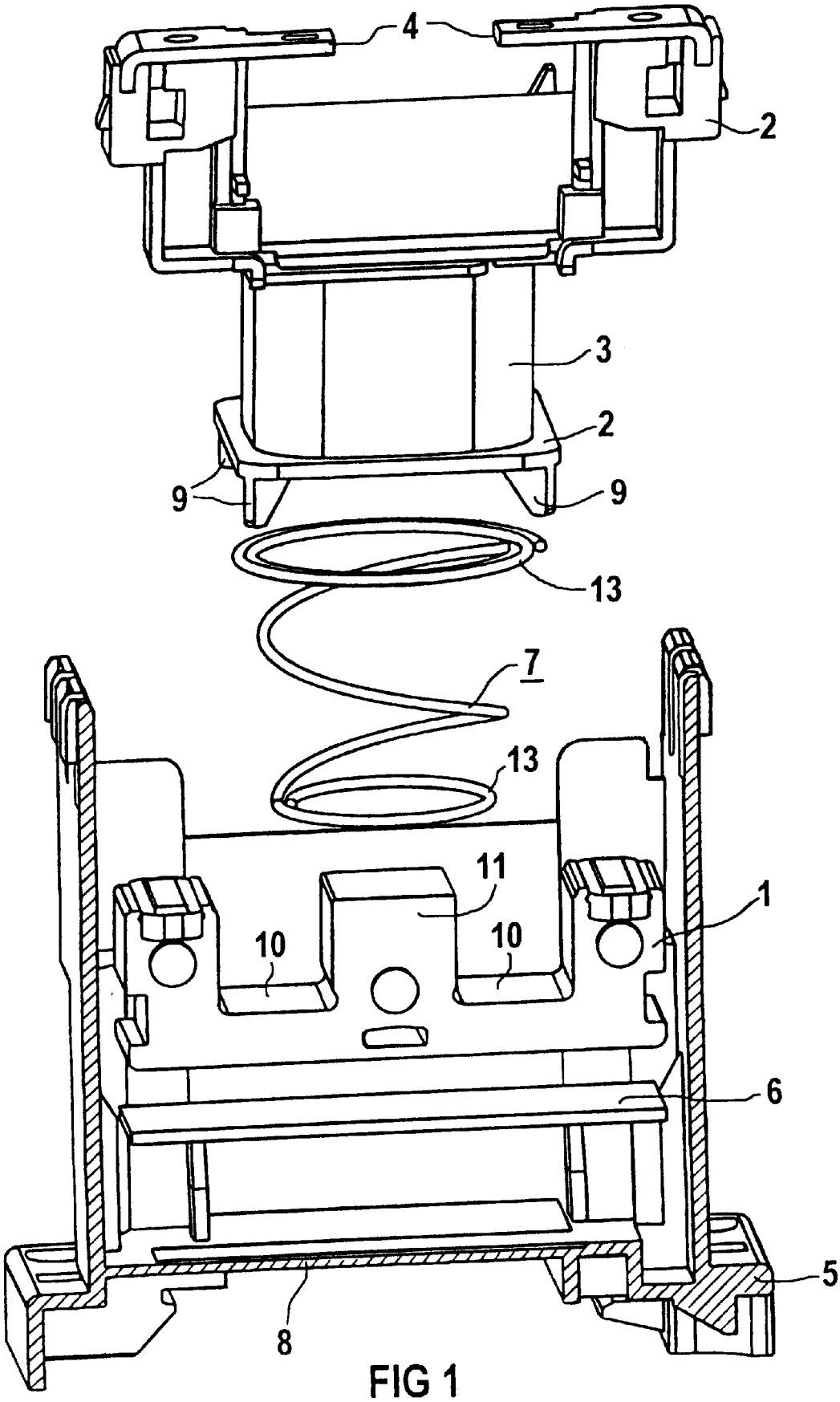
FIG. 1 shows an exploded diagram of a magnet damping arrangement in accordance with the present invention.

FIG. 1 shows an exploded view of a magnet damping arrangement essential, including as essential elements a non-switching magnet yoke 1 to be damped, a bobbin 2 with a magnet coil 3 and coil terminals 4, a housing bottom part 5, a damping rubber part 6 and a damping compression spring 7. Bobbin 2 is provided at its end face facing magnet yoke 3 with beveled projections 9 as the first holding elements which serve to support and center conical damping compression spring 7 on its larger spring end spire 13.

Figure 2:
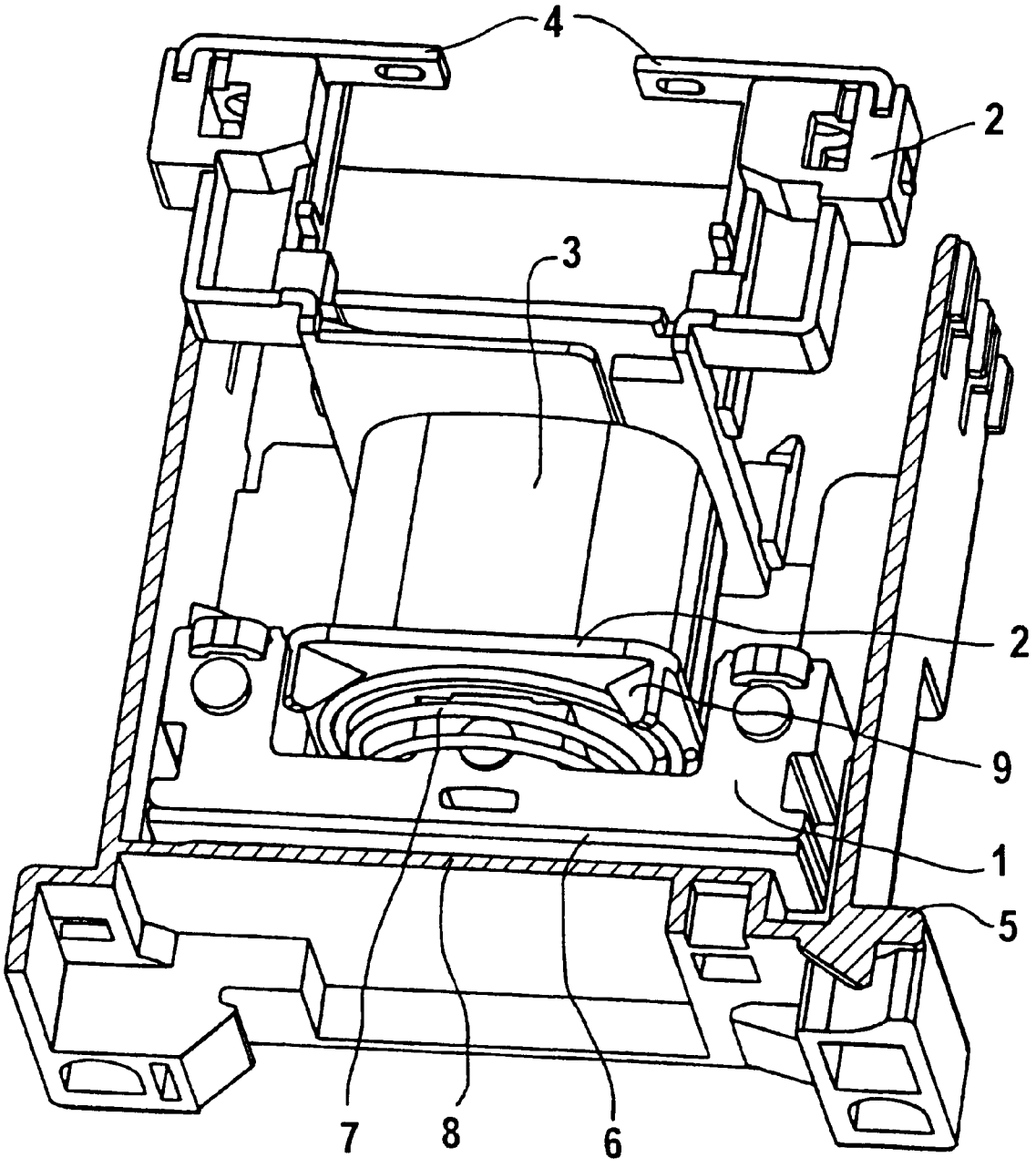
FIG. 2 shows the magnet damping arrangement in accordance with the present invention in an assembled state.

Magnet yoke 1, which is designed here in an E shape, is in contact with housing bottom wall 8 of housing bottom part 6 with the intermediate strip of damping rubber part 6 and is pressed in the direction of housing bottom wall 8 by the spring force of damping compression spring 7. Vibration of magnet yoke 1 due to impact of the movable armature (not shown here) in starting the electromagnet system is damped by damping compression spring 7, which is supported with its smaller spring end spire 13 on inside face 10 of magnet yoke 1 facing bobbin 2. The smaller spring end spire 13 is inverted over the middle leg 11 of the E-shaped magnet yoke 1 and is thereby held and centered. In the assembled state according to FIG. 2, middle leg 11 of magnet yoke 1 is inserted in a form-fitting manner into a central opening in bobbin 2.

Figure 3:
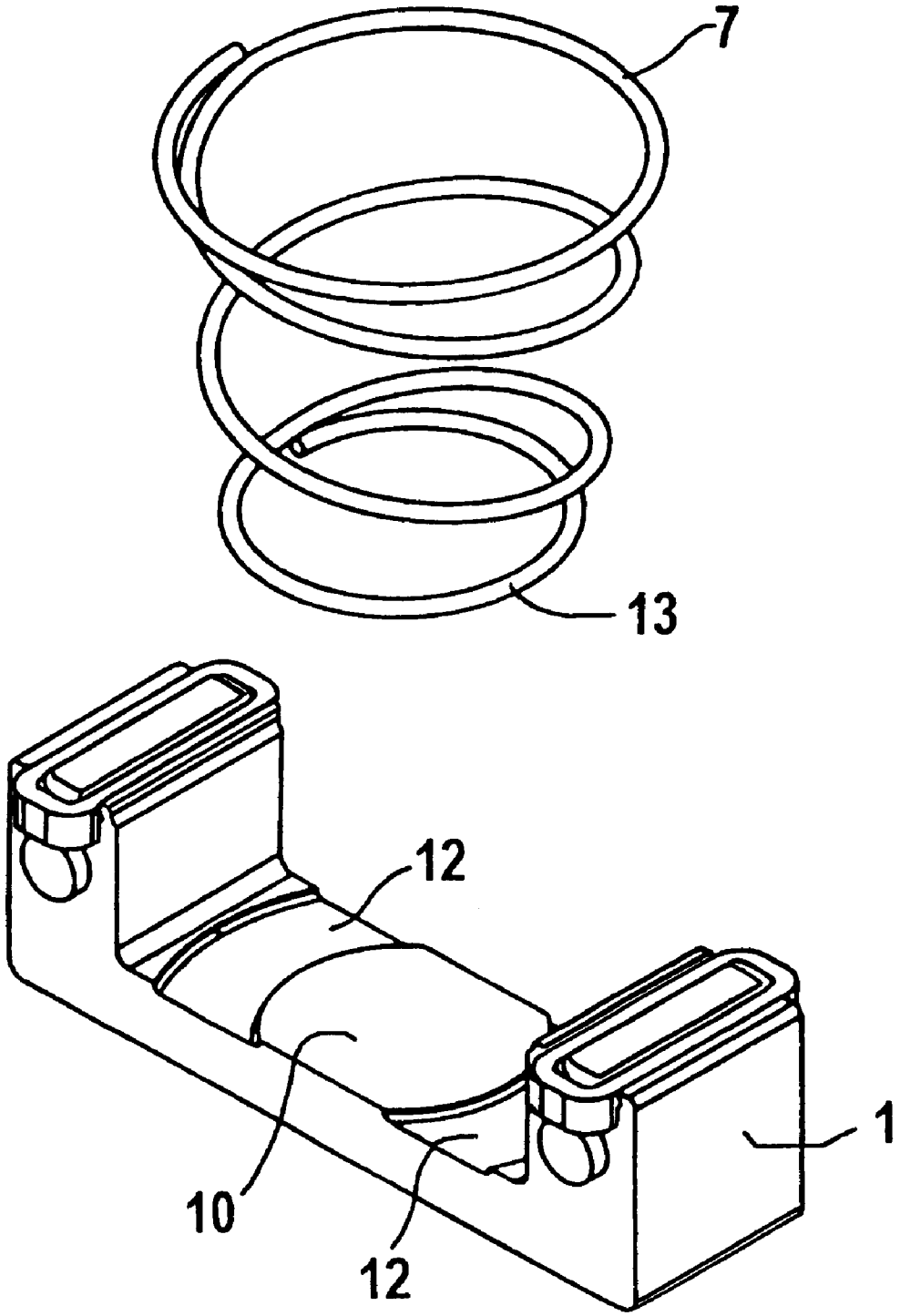
FIG. 3 shows a magnet yoke in accordance with the present invention.

As an alternative, other designs are also conceivable for supporting damping compression spring 7 on magnet yoke 1. For example, a circular groove 12 could be cut into inside face 10 of magnet yoke 1 as a second holding element according to FIG. 3 to accommodate the smaller spring end spire 13 of damping compression spring 7.

Modifications due to different holding elements for damping compression spring 7 are of course also possible without altering the inventive nature of the direct support of only one single damping compression spring 7 on bobbin 2 on the one end and on magnet yoke 1 on the other end.

What is claimed is:

1. A magnet damping arrangement, comprising:

an electromagnet switching system including a non-switching magnet yoke and a magnet coil, the non-switching magnet yoke having an E shape, and the magnet coil including a bobbin; and a single damping compression spring having a first end and a second end, the single damping compression spring being positioned on the non-switching magnet yoke, the first end being supported on the bobbin, and the second end being supported directly on a middle leg of the non-switching magnet yoke, the single damping compression spring holding and damping the non-switching magnet yoke.

2. The magnet damping arrangement according to claim 1, wherein the single damping compression spring includes a conical spring having a first spring end spire at the first end and a second spring end spire at the second end, the first spring end spire having a larger diameter than a diameter of the second spring end spire and being positioned on the bobbin.

* * * * *